US006354920B1

(12) United States Patent
Judge et al.

(10) Patent No.: US 6,354,920 B1
(45) Date of Patent: Mar. 12, 2002

(54) CENTERLESS CAMSHAFT MICROFINISHING MACHINE

(76) Inventors: Norman Roy Judge, 8315 W. Eaton Hwy., Grand Ledge, MI (US) 48837; Lowell Walter Benickson, 8110 Millett Hwy., Lansing, MI (US) 48917; John Alfred Payne, 1642 Royston Rd., Eaton Rapids, MI (US) 48827

( * ) Notice: Subject to any disclaimer, the term of this patent is extended or adjusted under 35 U.S.C. 154(b) by 0 days.

(21) Appl. No.: 09/616,549

(22) Filed: Jul. 14, 2000

Related U.S. Application Data

(60) Provisional application No. 60/144,555, filed on Jul. 16, 1999.

(51) Int. Cl.[7] ..... B24B 1/00

(52) U.S. Cl. ..... 451/62; 451/242; 451/307; 451/303

(58) Field of Search ..... 451/9, 10, 11, 451/49, 62, 242, 243, 246, 249, 251, 399, 296, 303, 307

(56) References Cited

U.S. PATENT DOCUMENTS 5,367,866 A * 11/1994 Phillips ..... 451/307
5,722,878 A * 3/1998 Phillips ..... 451/49
5,951,377 A * 9/1999 Vaughn et al. ..... 451/49
5,975,995 A * 11/1999 Hykes et al. ..... 451/62

* cited by examiner

*Primary Examiner*—Derris H. Banks
(74) *Attorney, Agent, or Firm*—Brinks Hofer Gilson & Lione

(57) ABSTRACT

A centerless microfinishing machine especially adapted for machining camshaft workpieces. The microfinishing machine causes the camshaft workpiece to rotate through the use of a centerless drive system including spaced rollers which frictionally engage the workpiece. A tooling head assembly strokes between engage and disengage positions and includes individual shoes which simultaneously engage the camshaft lobe and camshaft bearing journal surfaces. Through the use of separate compliant elements, these tools are caused to follow the contours of the surfaces being machined. The tooling head assembly allows these surfaces to be machined simultaneously; therefore, multiple machine functions can be accomplished in a single manufacturing step, which reduces the number of individual pieces of equipment which are required in accordance with typical machining approaches.

13 Claims, 6 Drawing Sheets

30
14
48
50
28
26
12
44
24
32

CENTERLESS CAMSHAFT MICROFINISHING MACHINE

This application claims benefit of Ser. No. 60,144,555 filed Jul. 16, 1999.

BACKGROUND AND SUMMARY OF THE INVENTION

This invention is related to a machine tool, and particularly, to a microfinishing machine for workpieces such as internal combustion camshafts operating on a centerless turning principle.

Numerous components for machines require microfinishing operations which produce high quality surface finishes of known characteristics. Microfinishing of surfaces is necessary to ensure proper friction and wear properties of the components in use. Microfinishing is especially significant where sliding contact between surfaces occurs during operation of a machine. Internal combustion engines of modem day motor vehicles include numerous components having microfinishing requirements. Crankshafts, which convert the reciprocating motion of the pistons into a rotary output, have numerous cylindrical journal surfaces which require microfinishing. The assignee of this invention, the Industrial Metal Products Corporation (IMPCO), has been an innovator of numerous machines and processes in the microfinishing area, particularly oriented toward crankshaft microfinishing. U.S. patents on these innovations include U.S. Pat. Nos. 4,682,444; 5,095,663; 5,148,636; and 5,531,631; which are hereby incorporated by reference.

In addition to internal combustion engine crankshafts, camshafts also require microfinishing. Camshafts typically have a number of cylindrical surfaces formed on them, rotating within simple journal bearings in the engine. Typically, a belt, chain, or gear, drives the camshaft to rotate in a synchronized manner with the rotation of the crankshaft. A number of cam lobes along the camshaft interact with cam followers to actuate the valves which control the intake and exhaust processes within the engine. In a typical four-stroke, internal combustion engine, two lobes are devoted to each cylinder, with one lobe controlling the intake valve and the other controlling the exhaust valve. More sophisticated internal combustion engines use multiple intake and exhaust valves per cylinder and require a corresponding increase in the number of lobes formed on the camshaft (or camshafts). Both the journal bearing surfaces and the cam lobe surfaces of the camshaft often require microfinishing operations. Camshaft blanks are normally formed from cast iron. The rough castings are machined in a number of steps including grinding operations to form the journal and cam surfaces. Microfinishing of camshafts is a known process which has been in use for many decades. In one process in use, the camshaft is turned between fixed centers in the manner of a lathe, with microfinishing tools acting on the bearing journal surfaces, and at a separate station, on the lobe surfaces. So-called "centerless" approaches are also known. In a centerless machine, a pair of rollers frictionally engage the cylindrical journal surfaces (or another cylindrical surface of the workpiece) and cause the camshaft to rotate. An abrasive tool, such as a stone or an abrasive-coated film may be used. An example of the centerless machine for the machining of ground shafts is found with reference to U.S. Pat. No. 5,231,798, which is hereby incorporated by reference and which is assigned to the assignee of this application.

In any machining process for workpieces, it is desirable to reduce the number of individual stations where metal finishing operations are completed. By reducing the number of stations, the part handling equipment is made simpler. Moreover, the probability for damage to workpieces, caused by mishandling, is reduced where individual stations can be eliminated. Plant floor space is also reduced in such conditions. The structure for the machine tools and drive system adds cost where multiple stations are required. In present microfinishing operations of camshafts, the machining of the cam lobes and journals occurs at different stations. This results in dedicated individual machining centers required for those surfaces.

In view of the foregoing, it is the object of this invention to provide a microfinishing machine which enables journal and camshaft lobe surfaces of a camshaft to be machined in a single operation by one machine. Workpiece handling is also facilitated through the use of a centerless system for the microfinishing machine.

Further objects, features and advantages of the invention will become apparent from a consideration of the following description and the appended claims when taken in connection with the accompanying drawings.

DETAILED DESCRIPTION OF THE INVENTION

Figure 5:
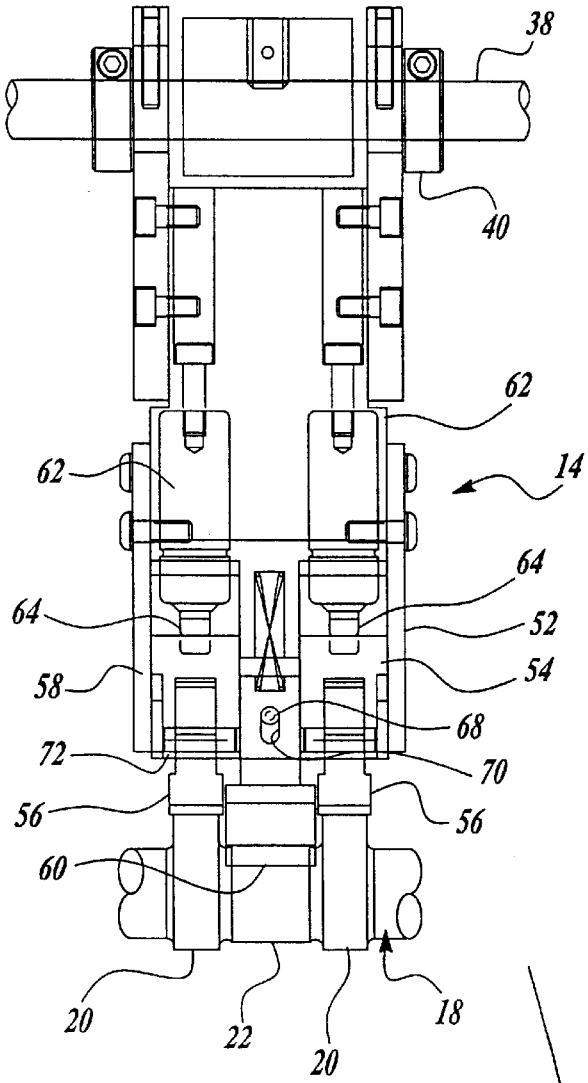
FIG. 5 is a front view of the lower portion of the tooling head assembly in accordance with this invention.
Figure 7:
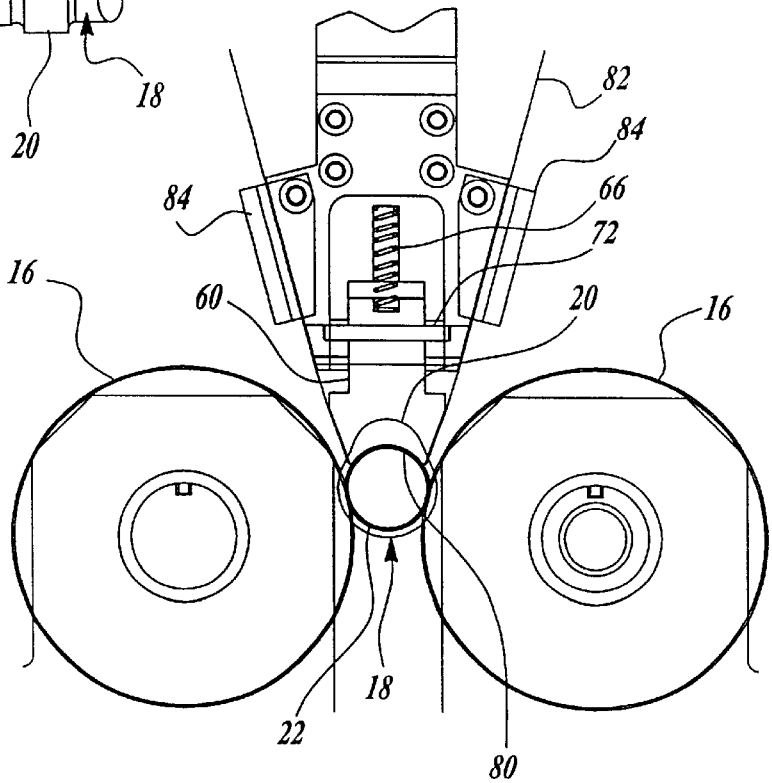
FIG. 7 is a side view particularly illustrating the bearing journal machining tool of the tooling head assembly of this invention and further showing the drive rollers of the machine.

Centerless microfinishing machine 10 includes, as principal components, frame 12, tooling head assembly 14, and drive rollers 16. Tooling head assemblies 14 are mounted in the upper portion of frame 12 and include tooling elements which are described in more detail later in this description, which act on a workpiece. Drive rollers 16, also shown in FIG. 7, are caused to rotate by a drive system within frame 12. Drive rollers 16 engage a workpiece in the manner of a conventional centerless machining system. The centerless microfinishing machine 10 of this invention is especially adapted for machining camshaft workpieces 18. As stated previously, camshafts are rotating shafts, featuring cam lobe surfaces which actuate valves in internal combustion engines. A portion of camshaft 18 is illustrated in FIG. 5. Camshaft 18 (typically) features a plurality of cam lobes 20 and cylindrical journal bearing surfaces 22. In accordance with a principal feature of this invention, one or more cam lobes 20 are machined simultaneously by the tooling head assembly 14, along with one or more cylindrical bearing surfaces 22. Cam lobes 20 and cylindrical bearing surfaces 22 are typically juxtaposed along the axial length of camshaft 18. In the example of camshaft 18, illustrated in FIG. 5, cylindrical bearing surface 22 is present between adjacent lobes 20.

Figure 1:
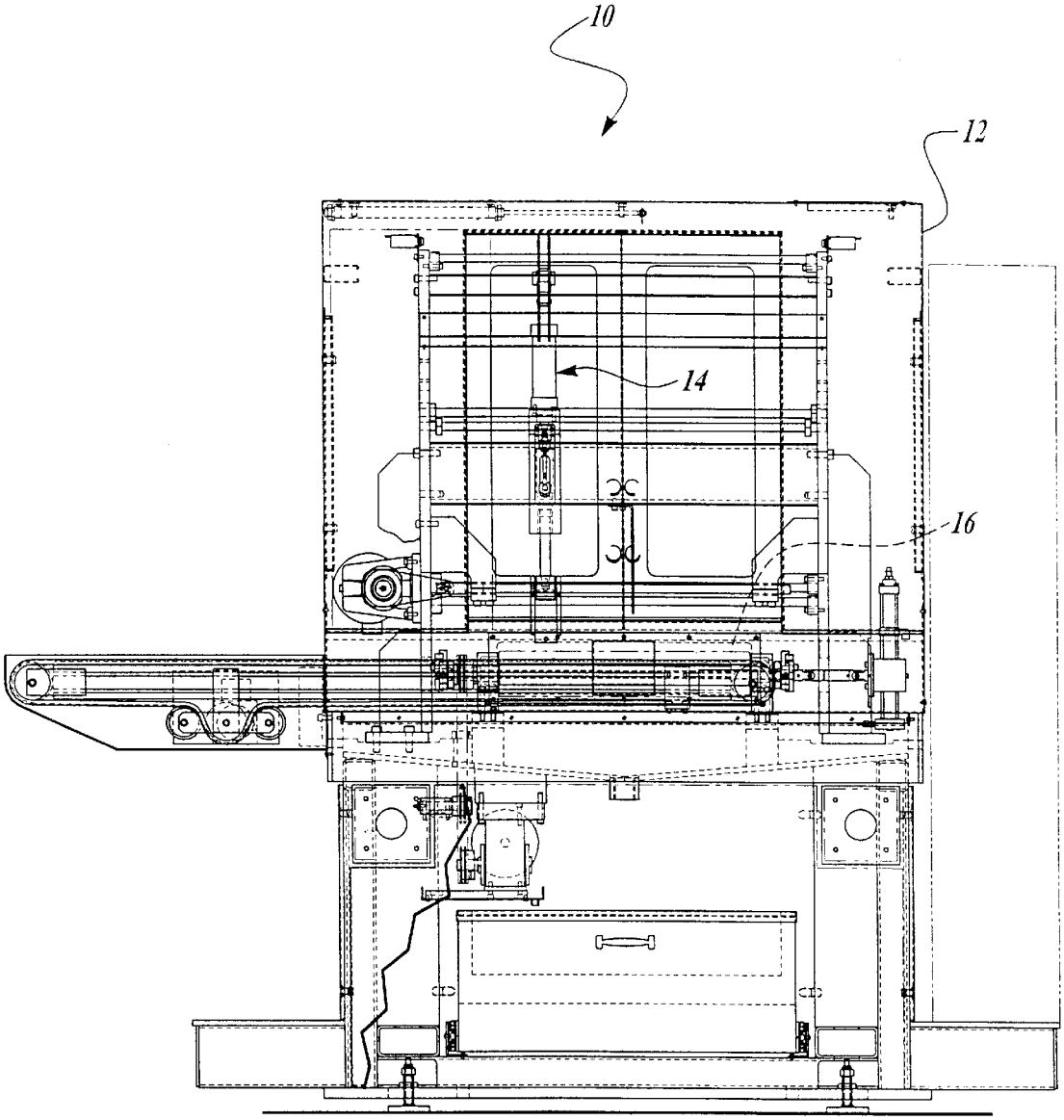
FIG. 1 is a frontal view of the centerless microfinishing machine of this invention.
Figure 2:
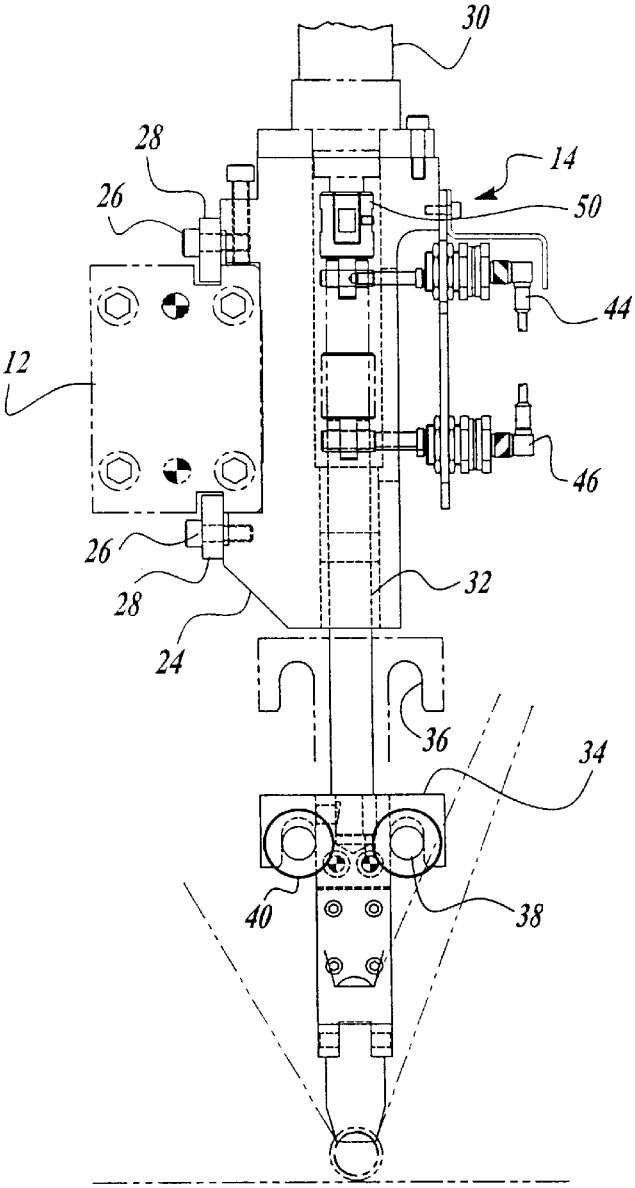
FIG. 2 is a side view of the tooling head assembly in accordance with this invention.
Figure 4:
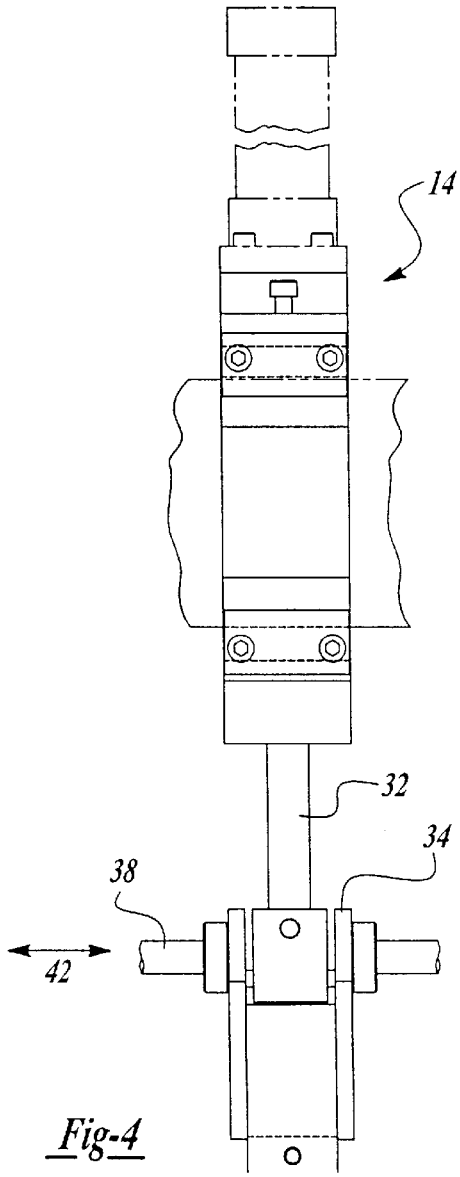
FIG. 4 is a front view of the upper portion of the tooling head assembly in accordance with this invention.
Figure 3:
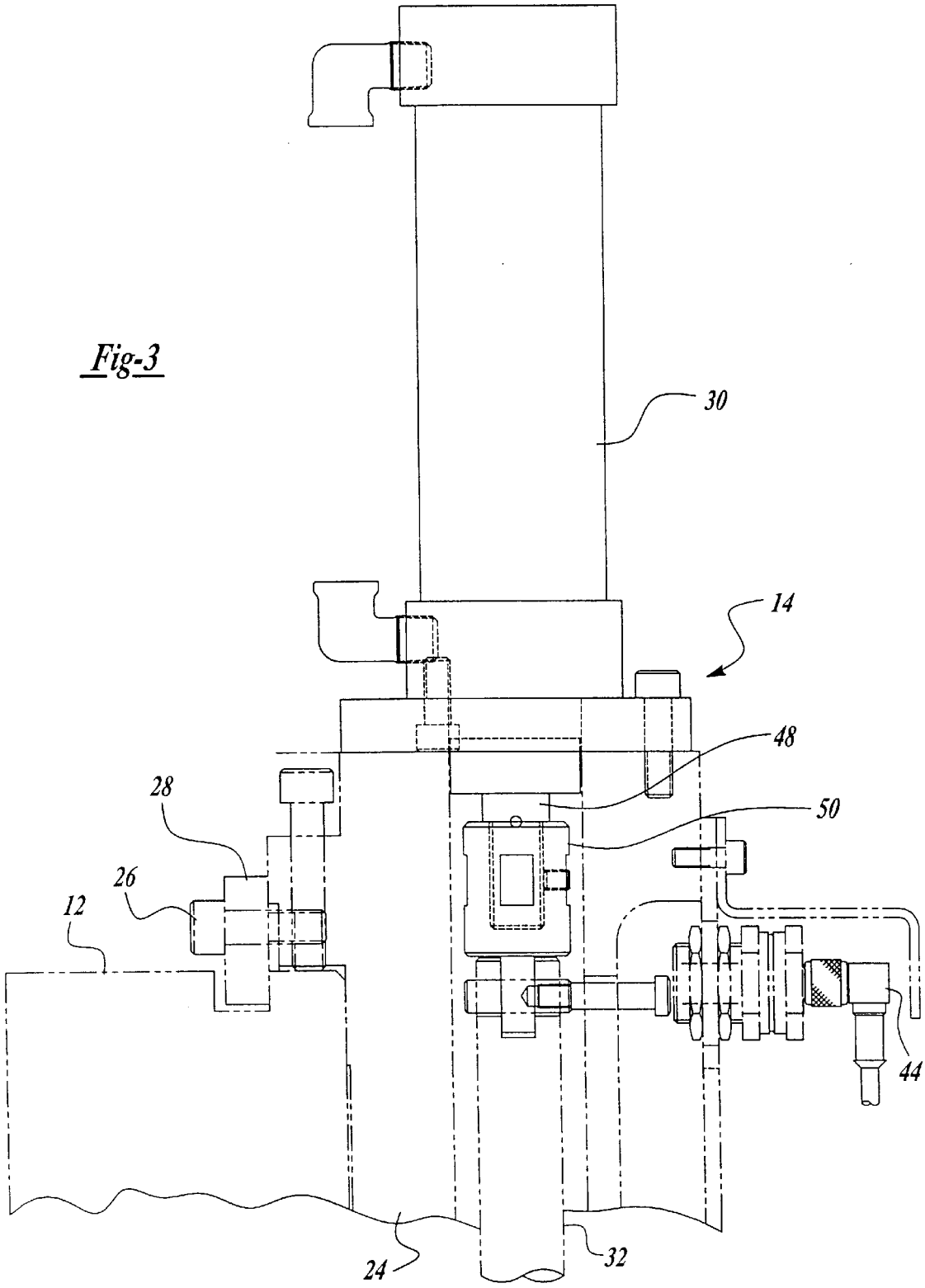
FIG. 3 is a side view of the upper portion of the tooling head assembly shown in FIG. 2.

Tooling head assembly 14 is best illustrated with reference to FIGS. 2 through 7. As shown in FIG. 2, tooling head assembly 14 is mounted to frame 12 through the use of mounting bracket 24. Cap screws 26 are threaded into mounting bracket 24 and cause mounting plates 28 to clamp against grooved surfaces of frame 12. Mounting bracket 24 includes a top mounted actuating cylinder 30 which may be air or hydraulically operated and is capable of stroking between an upward disengaged position, causing the tooling to be disengaged from the workpiece, to a downward engaged machining position. Cylinder shaft 48 is affixed to coupler 50, which is in turn, connected with slide plate 32 as best shown in FIG. 3. Slide plate 32 includes yoke 34 having a pair of open slots 36 which engage with oscillating shafts 38. Oscillating shafts 38 include a pair of protruding collars 40 which can be formed integrally by the oscillating shaft or through the use of installed ring elements which can be welded, braised, or mounted to the shafts 38 through the use of a set screw, roll pin, or other mechanical fastener. When actuating cylinder 30 is stroked to its downward position, yoke slots 36 engage oscillating shaft 38 as shown in FIG. 4. Collars 40 abut yoke 34. An oscillation drive mechanism (not shown) is affixed to frame 12 and causes oscillating shafts 38 to stroke in the direction of arrow 42. This is provided to produce a desired machine effect on the workpieces, as will be described in more detail in the following description.

As part of the control system of the microfinishing machine 10, a pair of proximity switches 44 and 46 are provided and mounted to frame 12. Proximity switches 44 and 46 provide an electrical output indicating the position of slide plate 32 between the open and machining positions.

Now with reference to FIG. 5, details of the lower portion of tooling head assembly 14 are shown. Slide plates 32 are connected with tooling head block 52. A pair of shoe supports 54 are provided for the camshaft finishing tool 56. A shoe support 58 is also provided for the main bearing journal tool 60. Each of the shoe supports 54 and 58 are able to stroke axially in the vertical direction relative to block 52 within a limited range of motion. Each of shoe supports 54 can stroke vertically against the compliant force provided by nitrogen filled cylinders 62. The bodies of nitrogen filled cylinders 62 are mounted to block 52, whereas their downwardly projecting plungers 64 engage shoe supports 54. Shoe support 58 is loaded compliantly through the use of coil spring 66. The range of vertical stroking motion of shoe support 58 is limited through pin 68 installed within elongated slot 70. Block 52 is shown in FIG. 5 in the downward machining position of tooling head assembly 14.

Microfinishing tools 56 for the cam lobe surfaces 20 are mounted to their shoe supports 54 through the use of a rocking pin 72. Rocking pin 72 allows tool 56 to pivot during the machining process as will be described in more detail in the following description.

Now with reference to FIG. 6, details of the drive rollers 16 and the machining operation for the cam lobes 20 will be described. A pair of drive rollers 16 engage bearing surfaces 22 of the camshaft 18. In order to provide clearance for rotation of lobes 20, it may be necessary to provide a grooved or slotted surface around drive roller 16 to prevent interference with the cam lobes as the camshaft 18 is rotated. The separation distance and diameters of drive rollers 16 are chosen to provide a desired friction drive angle through their engagement with camshaft 18. This angle is selected to cause a high turning torque to be applied to the workpiece during machining. This drive frictional force is in reaction to the vertically downward load applied to camshaft 18 through tooling head assembly 14. This drive angle can be defined as the angle form between a first line between the centers of one drive roller 16 through the center of camshaft 18, and a second line which extends between the centers of the drive rollers 16. Excessively small drive angles result in extremely high contact forces being exerted by drive rollers 16 onto the workpiece 18, which can lead to surface finish and form degradation at the points of contact with the workpiece. On the other hand, excessively large drive angles result in low drive torque as the rollers do not "bite" the workpiece. A drive angle of approximately 13° is believed to provide the desired balance of these factors.

Figure 6:
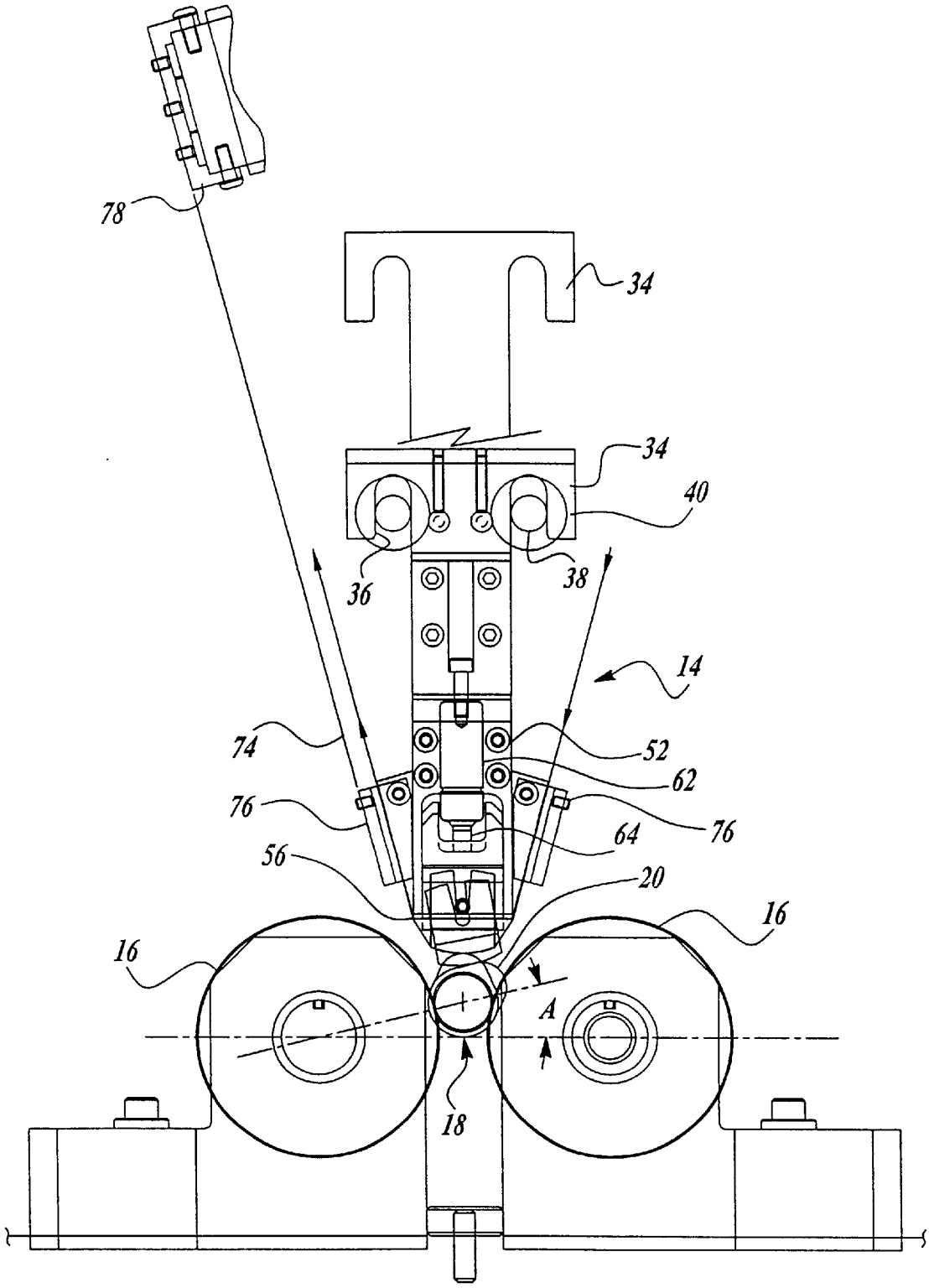
FIG. 6 is a side view particularly illustrating the camshaft lobe tooling of the tooling head assembly of this invention.

FIG. 6 particularly shows the machining components which act upon camshaft lobes 20. Tooling head assembly 14 is shown in FIG. 6 in the downward machining position. In this position, tool 56 is shown pressing abrasive coated film strip 74 against camshaft lobe 20. As shown, tool 56 is able to pivot or rock as the lobe 20 is rotated. This allows the microfinishing film strip 74 to "follow" the contour of the camshaft lobe 20 as it rotates. Various profile configurations for tool 56 may be employed. Although a generally convex surface for tool 56 is illustrated in FIG. 6, other configurations, such as concave surfaces or "V" shaped grooves can be provided. During machining, finishing strip 74 is maintained in position through actuation of tape clamps 76. As multiple parts are machined, finishing strip 74 becomes worn; therefore, there is a need to index finishing strip 74 between operations. This is accomplished through actuation of film indexing jaw 78. Actuation of jaw 78 is coordinated with tape clamp 76 such that the tape clamps 76 are open as the film is indexed and clamped to fix the position of the film finishing strip during machining. Preferably, abrasive coated polymer films, such as those manufactured by the 3M Corporation, are used for this process. Alternatively, however, paper or cloth materials, which are coated with abrasive grains, can also be used. Moreover, it is possible to replace the machining film of this invention with tools 56 and 60, which are formed of an abrasive material, such as honing stone or ceramic compounds and avoid the use of strip 74. However, that approach is not preferred since it results in the need to frequently redress or replace the tools.

Now with reference to FIG. 7, tool 60 is shown in more detail. Tool 60 includes a concave machining surface 80 which presses abrasive film strip 82 against the journal surface being machined. This figure also depicts coil spring 66 and pin 68 acting within slot 70. Tape clamps 84 operate in an identical manner to tape clamps 76 as described previously. Since the surface of the cylindrical bearing journals 22 is concentric with the axis of rotation of the camshaft 18, it is not necessary to provide significant rocking or pivoting motion for tool 60.

Now, again, turning to FIG. 5, operation of centerless microfinishing machine 10 will be described. FIG. 5 illustrates tooling head assembly 14 in the downward machining position. As cylinder 30 is actuated to the downward position, yokes 34 become seated in contact with oscillating shafts 38. The mechanisms are dimensioned such that, in the downward position, compression of spring 66 occurs through engagement of tool 60 with bearing surfaces 22. Similarly, compression of nitrogen filled cylinders 62 occurs in the actuated position through engagement between tools 56 and cam lobes 20. Upon rotation of camshaft 18, engagement of lobes 20 with their tools 56 will cause nitrogen filled cylinder plungers 64 to stroke. This system enables the simultaneous machining through the use of tooling head assembly 14 of both camshaft lobe 20 and bearing surface 22. Although stroking of nitrogen filled cylinder plungers 64 results in a variable net downward pressure being exerted onto camshaft 18 (which is the sum of the downward forces exerted through contact by tools 56 and 60 on the camshaft 18), this variable pressure does not adversely affect the drive conditions provided by drive rollers 16. During the machining process, oscillating shafts 38 are stroked axially to cause tools 56 and 60 to also oscillate on their corresponding camshaft surfaces. This provides a desired cross hatch pattern in the surface finish generated on the surfaces. This is desirable to provide the desired friction, wear, and hydrodynamic bearing characteristics for the surfaces.

Figure 8:
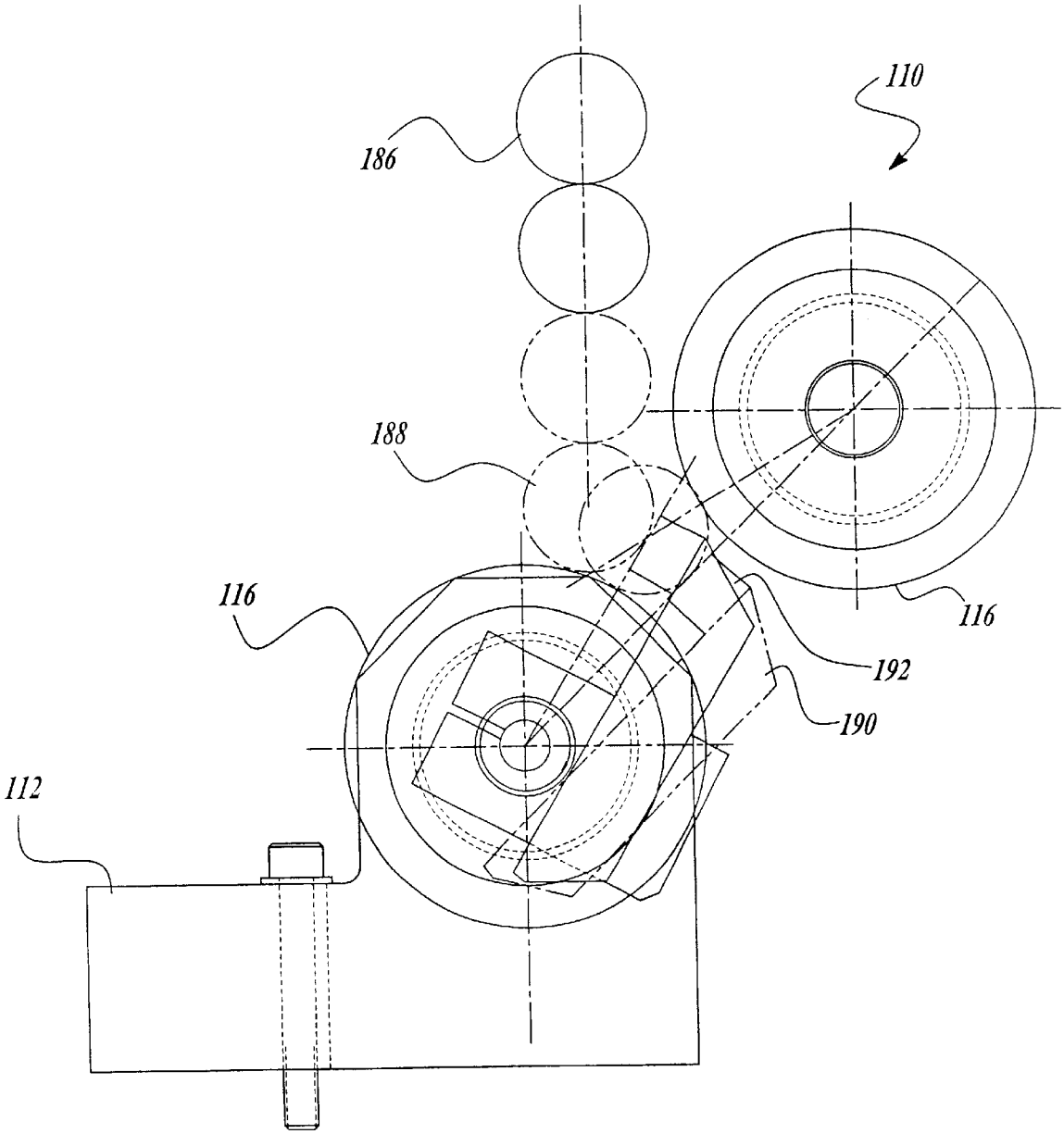
FIG. 8 is a side elevational view of a centerless microfinishing machine in accordance with an alternate embodiment of this invention in which the drive rollers are oriented differently as compared with the prior embodiment.

An alternate embodiment of centerless microfinishing machine 10 is illustrated in FIG. 8 and designated by reference number 110. Elements of centerless microfinishing machine 110, which are identical in function to those elements previously described, are identified by like numbers with one hundred added. Microfinishing machine 110 differs from machine 10 in that drive rollers 116 are located in a different orientation than described previously. Centerless microfinishing machine 10 includes drive rollers 16, which are oriented such that a line drawn between their centers is horizontal. In other words, camshaft workpieces 18 are dropped directly vertically downward into engagement with rollers 16 during parts loading and unloading. Microfinishing machine 110 features drive rollers 116, which are located at an angle of approximately 45° relative to a horizontal plane (the angle formed by a plane defined by the longitudinal axis of the drive rollers, and a horizontal plane). This enables more convenient access to the machining location for camshafts 18 during workpiece loading and unloading. Specifically, a gantry loading system can be used to deposit camshaft 18 from a vertical position indicated by reference number 186 to a load position shown by reference number 188. Once in position 188, the part can fall by gravity to its position of frictional engagement between drive rollers 116. This orientation for drive rollers 116 also enables the use of a convenient "bale" type workpiece unloading system. Bale 190 is rotated about the center of rotation of the lowermost of drive rollers 116. Bale 190 includes an elongated rail 192 which engages the workpiece. By rotating bale 190 about the drive roller center of rotation, the part can be engaged and "kicked out" of its engaged position between the drive rollers. This enables the workpiece to be easily ejected onto a unloading gantry mechanism (not shown). For microfinishing machine 110, tooling head assemblies (not shown) can be actuated to move in a purely vertical or a direction or at some angle to engage the camshaft 18 without interference with drive rollers 116. The tooling head assemblies for microfinishing machine 110 are identical to head assembly 14 described in connection with the first embodiment.

It is to be understood that the invention is not limited to the exact construction illustrated and described above, but that various changes and modifications may be made without departing from the spirit and scope of the invention as defined in the following claims.

What is claimed is:

1. A microfinishing machine for use with camshaft workpieces having at least one cylindrical journal surface and at least one cam surface, comprising:

a machine frame, at least a pair of drive rollers carried by said frame for engaging said camshaft workpiece and causing said workpiece to rotate, a tooling head having a block having at least one journal finishing tool for causing a machining effect on said camshaft journal, and at least one cam surface finishing tool for causing a machining effect on said cam surface, a first compliant means coupled to said tooling head for urging said journal finishing tool into engagement with said camshaft journal surface, a second compliant means coupled to said tooling head for urging said cam surface finishing tool into engagement with said camshaft cam surface, and tooling head actuation means for moving said tooling head between a disengaged position from said camshaft in which said cam surface finishing tool and said journal finishing tool are separated from said camshaft to an engaged position with said camshaft in which said cam surface finishing tool and said journal finishing tool are engaged with said camshaft, wherein rotation causes rotation of said camshaft and said finishing tools provide a machining effect on said camshaft.

2. A microfinishing machine according to claim 1, further comprising a first abrasive coated film positioned between said cam surface finishing tool and said cam surface.

3. A microfinishing machine according to claim 1, further comprising a second abrasive coated film positioned between said camshaft journal surface finishing tool and said camshaft journal surface.

4. A microfinishing machine according to claim 1, wherein said first compliant means comprises a coil spring carried by said tooling head.

5. A microfinishing machine according to claim 1, wherein said second compliant means comprises a gas spring carried by said tooling head.

6. A microfinishing machine according to claim 1, wherein said tooling head actuation means comprises a fluid actuated cylinder coupled to said machine frame and said tooling head.

7. A microfinishing machine according to claim 1, further comprising oscillation means coupled to said machine frame and said tooling head for causing said tooling head to oscillate during machining of said camshaft.

8. A microfinishing machine according to claim 7, wherein said oscillation means comprises at least one shaft coupled to said tooling head when said head is in said machining position and oscillates to impart oscillation in said tooling head.

9. A microfinishing machine according to claim 1, wherein said drive rollers are oriented such that a plane defined as including the longitudinal axes of said drive rollers is a horizontal plane.

10. A microfinishing machine according to claim 1, wherein said drive rollers are oriented such that a plane defined as including the longitudinal axes of said drive rollers is inclined from a horizontal plane.

11. A microfinishing machine according to claim 1, wherein said drive rollers are oriented such that a plane defined as including the longitudinal axes of said drive rollers is inclined about 45 degrees from a horizontal plane.

12. A microfinishing machine according to claim 1, wherein said drive rollers are oriented such that a plane defined as including the longitudinal axes of said drive rollers is a horizontal plane.

13. A microfinishing machine according to claim 1, wherein said drive rollers are oriented such that they interact with said camshaft workpiece to form a drive angle of about 13 degrees.

* * * * *